US006100854A

United States Patent [19]

Dusseux et al.

[11] Patent Number: 6,100,854

[45] Date of Patent: Aug. 8, 2000

[54] ANTENNA WITH ONE-WAY CIRCULAR POLARIZATION

[75] Inventors: Thierry Dusseux, Tournefeuille; Emmanuelle Husse, Toulouse; Hervé Legay; Michel Pauchet, both of Plaisance du Touch, all of France

[73] Assignee: Alcatel, Paris, France

[21] Appl. No.: 09/121,856

[22] Filed: Jul. 24, 1998

[30] Foreign Application Priority Data

Jul. 28, 1997 [FR] France ..... 97 09569

[51] Int. Cl.[7] ..... H01Q 13/00

[52] U.S. Cl. ..... 343/772; 343/756; 333/21 A

[58] Field of Search ..... 343/772, 771, 343/756, 786, 909; 333/21 A, 21 R, 135, 137

[56] References Cited

U.S. PATENT DOCUMENTS

| | | | |
|---|---|---|---|
| 3,031,661 | 4/1962 | Moeller et al. | 343/756 |
| 4,498,061 | 2/1985 | Morz et al. | 333/21 A |
| 5,276,456 | 1/1994 | Kim | 343/756 |
| 5,305,001 | 4/1994 | Wong et al. | 343/786 |

FOREIGN PATENT DOCUMENTS

| | | |
|---|---|---|
| 0178259A2 | 4/1986 | European Pat. Off. . |
| 0252269A1 | 1/1988 | European Pat. Off. . |
| 94827 | 2/1964 | United Kingdom . |

*Primary Examiner*—Tan Ho

*Attorney, Agent, or Firm*—Sughrue, Mion, Zinn, Macpeak & Seas, PLLC

[57] ABSTRACT

An antenna having one-way circular polarization is of the type comprising a radiating element associated with a frequency filter. It comprises a polarization-selective device disposed at the transition between the frequency filter and polarizer means adapted to cause the wave to be circularly polarized. This multimode selective device is adapted 1) to enable the initial go mode to propagate, 2) in transmission, to pass one of the return modes induced by the polarizer means, and 3) to reflect the other return mode. At the polarizer, the wave made up of the initial mode and of the reflected return modes reinforces the circular polarization of the initial mode. Such an antenna can be made as a single piece of size and weight that are smaller than those of known antennas having one-way circular polarization.

7 Claims, 5 Drawing Sheets

ANTENNA WITH ONE-WAY CIRCULAR POLARIZATION

The invention relates to an antenna for transmitting and receiving radiation having one-way circular polarization, the antenna being of the type comprising a frequency filter and a radiating element for transmitting or receiving in a predetermined frequency band referred to as the "working" band. The invention applies more particularly to active antennas in which the working band lies in the microwave range.

BACKGROUND OF THE INVENTION

In known antennas of the above-specified type, the filter serves to adjust the width of the working band radiated by the radiating element and to comply with given specifications concerning rejection outside the working band. As a transition between the filter and the radiating element, such antennas possess a monomode link which interconnects said elements; the monomode link is associated with a polarizer so as to feed the radiating element in such a manner as to generate the circular polarization of the transmitted wave. Such a monomode link is of considerable mass and length, and constitutes an obstacle to reducing the weight and the size of the antenna. In addition, it can give rise to non-negligible energy losses.

OBJECTS AND SUMMARY OF THE INVENTION

The present invention seeks to provide an improved antenna of the above-specified type, suitable for being generally more compact than known antennas.

Another object is to enable the mass of the antenna to be reduced significantly, where such an advantage is highly prized in space applications.

Another object is to reduce constraints on manufacturing the antenna, and in particular to enable it to be made as a single piece.

Another object is to reduce energy losses.

To this end, the antenna of the invention having one-way circular polarization comprises a radiating element associated with a frequency filter, wherein:

- the radiating element is coupled by means of a polarizer adapted to ensure that the wave is circularly polarized, inducing two orthogonal return transmission modes (Rh, Rv);
- a polarization-selective device is disposed at the transition between the frequency filter and the polarizer means, said multimode selective device being adapted 1) to enable the initial go mode (Ma) in transmission to propagate, 2) to pass one of the return modes (Rh) induced by the polarizer means, and 3) to reflect the other return mode (Rv);
- the frequency filter is adapted, in transmission, to reflect the return mode (Rh) which is applied thereto by the polarization-selective device; and
- the polarizer means is matched to the composite wave made up of the initial mode (Ma) and of the reflected return modes in such a manner as to reinforce the circular polarization of the initial wave.

Thus, between the filter and the radiating element, the antenna of the invention is provided with a multimode selective device suitable for propagating two orthogonal transmission modes. The polarizer means excited by the multimode device generate two orthogonal return modes which are used in transmission by means of the reflections to reinforce generation of the circular polarization of the initial go mode (Ma). The multimode selective device can thus be considerably more compact and lighter in weight than the monomode link of known antennas (which must of sufficient length to limit return waves) and it leads to easier manufacturing constraints. In particular, in the microwave range, the filter, the selective device, the polarizer, and the radiating element can be manufactured simultaneously as a single piece (in particular as a casting), thereby avoiding multiple fabrication and assembly operations. In addition, the resonance of the polarizer means at the frequency of the composite wave improves transmission energy efficiency compared with the above-mentioned known antennas.

In ordinary manner, the antenna of the invention can be made of a metal material that is electromagnetically linear. Under such circumstances, given the reciprocity principle, the radio characteristics obtained in transmission (in particular the improved energy efficiency) are also obtained in reception.

In a preferred embodiment, the frequency filter is an evanescent mode filter provided with a plurality of discontinuities which are aligned along the longitudinal axis of the filter, and each of which is symmetrical about a longitudinal plane of symmetry of the filter. The polarization-selective device then comprises a waveguide of circular or rectangular section having transverse dimensions that are suitable for conveying both orthogonal fundamental modes of the waveguide, a discontinuity being disposed at the filter/waveguide interface in alignment with the discontinuities of the filter for the purpose of passing one of the return modes (Rh) and reflecting the other return mode (Rv).

Such an evanescent mode filter is a filter below cutoff whose transverse dimensions are smaller than those of the other components of the antenna, thereby making it easier to build up an antenna array by placing radiating elements side by side.

In another embodiment, the frequency filter is a propagation filter possessing a monomode outlet in the form of a rectangular or circular waveguide. The polarization-selective device then comprises a waveguide of circular or rectangular section having transverse dimensions appropriate for conveying both orthogonal fundamental modes of the waveguide, a grid of parallel metal wires or strips being disposed at the interface between the filter and the waveguide to pass one of the return modes (Rh) and to reflect the other return mode (Rv).

In such an embodiment, the transverse dimensions of the filter are greater than in the preceding case, but it gives a wider range of working bandwidth. Such an antenna is more particularly suitable for use as a single antenna.

In addition, the polarizer means is preferably constituted by at least one iris that is asymmetrical about a plane containing the electric field of the initial go mode (Ma). Circular polarization is thus obtained by a component that is very compact and that is disposed at the interface between the radiating element and the polarization-selective device.

According to another advantageous characteristic of the invention, the polarization-selective device and the radiating element are waveguides of transverse dimensions appropriate for allowing propagation solely of the two orthogonal fundamental modes. These dispositions lead to a device of size that is smaller than the wavelength, thereby limiting the influence of higher modes (which remain evanescent).

As already mentioned, the above-defined antenna can be associated with a plurality of antennas of the same type to build up an array: this provides an antenna of increased directivity whose beam can be pointed electronically.

BRIEF DESCRIPTION OF THE DRAWINGS

Other characteristics, objects, and advantages of the invention appear from the following description given with reference to the accompanying drawings, which drawings show embodiments of antennas of the invention as non-limiting examples. In the drawings.

MORE DETAILED DESCRIPTION

Figure 1:
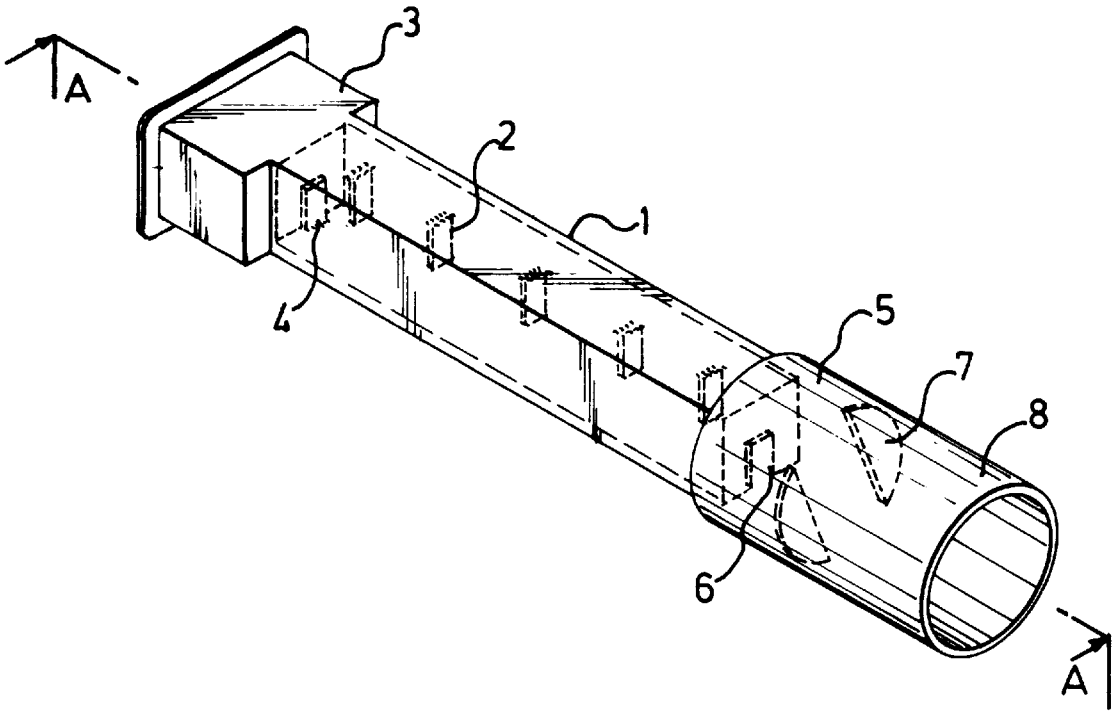
FIG. 1 is a diagrammatic perspective view of a first embodiment.
Figure 2:
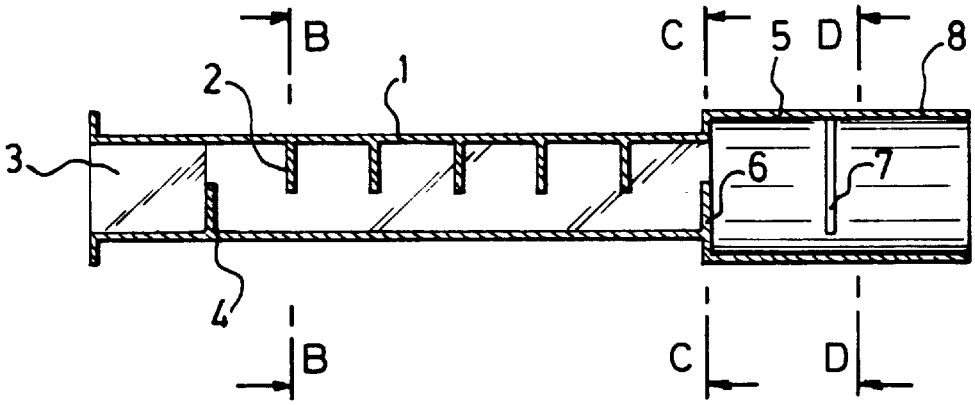
FIG. 2 is a longitudinal section view on longitudinal plane AA.
Figure 3:
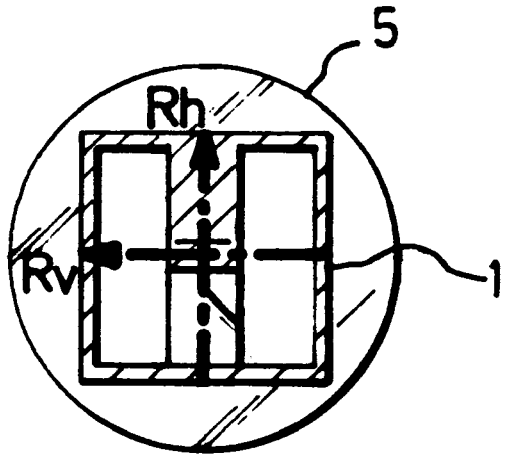
FIGS. 3, 4, and 5 are cross-sections respectively on planes BB, CC, DD.
Figure 4:
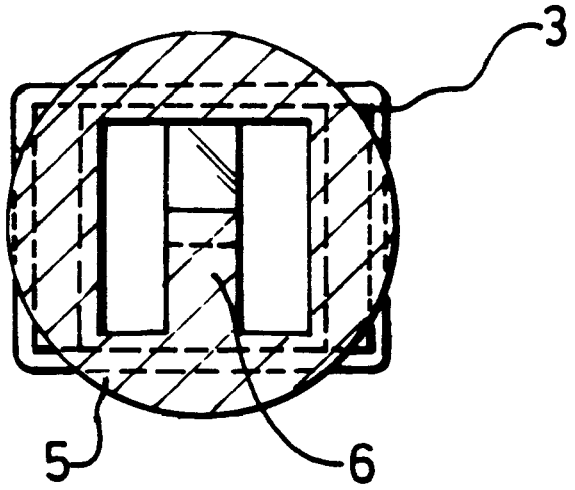
Figure 5:
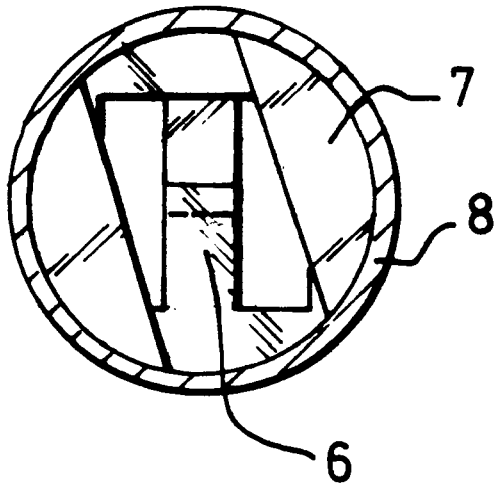

The antenna having one-way circular polarization that is shown by way of example in FIGS. 1 to 5 is designed to transmit and receive microwave radiation having a working band of predetermined bandwidth, e.g. of 500 MHz bandwidth centered around 12 GHz.

The antenna comprises a frequency filter constituted by a rectangular waveguide 1 having an evanescent fundamental mode, provided with blades such as 2 aligned along the axis of the waveguide and symmetrical about the longitudinal plane AA. The rectangular section of the waveguide is appropriate for both fundamental modes of the waveguide being below cutoff (sides of length shorter than $\lambda/2$).

In conventional manner, the filter possesses an excitation inlet 3 provided with a matching blade 4, said inlet being designed to be connected to an amplifier, a microwave generator, and a microwave receiver.

The waveguide 1 is extended by a cylindrical waveguide 5 enabling both orthogonal fundamental modes of propagate. To this end, the diameter of the waveguide 5 is greater than 0.586 $\lambda$. This waveguide 5 acts as a polarization-selective device and is provided with a blade 6 situated at the interface between the waveguides 1 and 5, in alignment with the blades 2 of the waveguide 1 and in opposition relative to the blades 2.

At the end of the waveguide 5, there is located a polarizing iris 7 that is asymmetrical about the plane AA. In particular, the two walls forming the iris 7 are offset at an angle of 70° relative to the plane AA.

The length of the waveguide 5 (between the blade 6 and the iris 7 for forming the selective device) is substantially equal to 0.4 $\lambda$ so as to set up beats in the waveguide 5 such that the iris 7 is excited by composite modes (the initial go mode and reflected modes). It should be emphasized that this length is considerably shorter than that a traditional monomode link which must be several wavelengths long (2 $\lambda$ to 3 $\lambda$).

Beyond the iris 7, the waveguide 5 is extended by a waveguide 8 of identical circular section acting as the radiating element.

The above-described antenna assembly is made as a single piece of cast aluminum.

In transmission, the waveguide 1 selects the microwave signal of the working band and reflects the out of band signal to the inlet 3. The initial mode in the working band passes along the waveguide 1 and the waveguide 5. The iris generates two orthogonal return modes Rh and Rv. The mode Rv is reflected at the interface between the waveguide 1 and the waveguide 5 since its electric field is in the plane perpendicular to the plane of symmetry AA of the filter. The mode Rh penetrates into the filter and is reflected by the blades 2. The reflected return modes travel along the waveguide 5 and combine with the initial go mode at the iris 7 to reinforce the circular polarization generated thereby.

Figure 6:
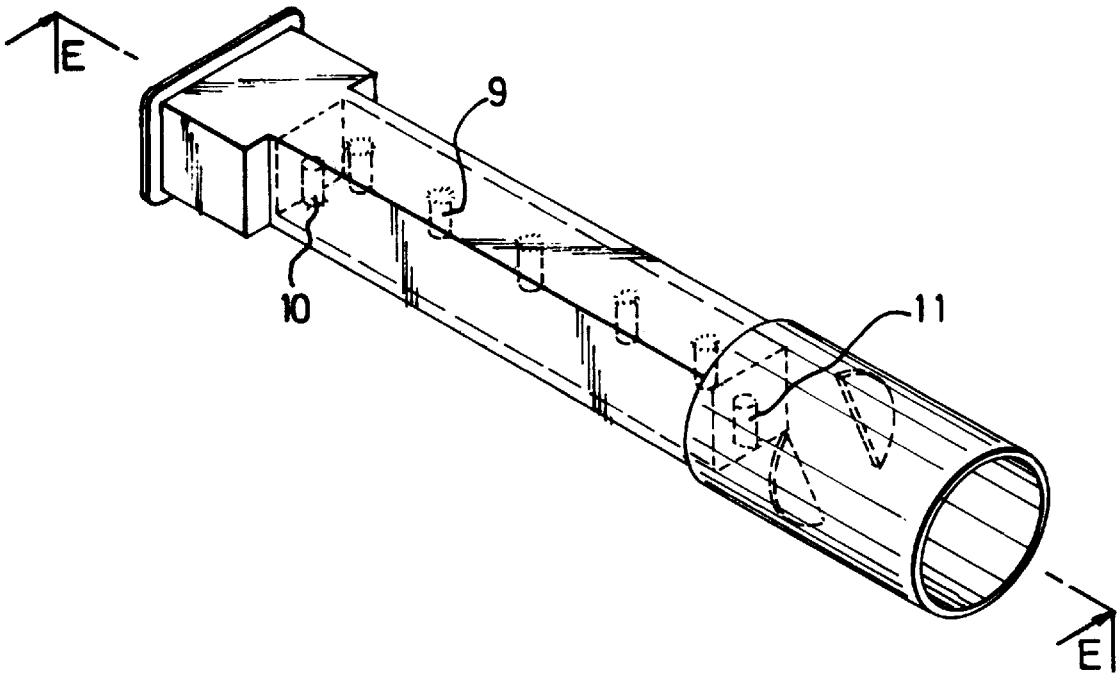
FIG. 6 is a diagrammatic perspective view of a variant.
Figure 7:
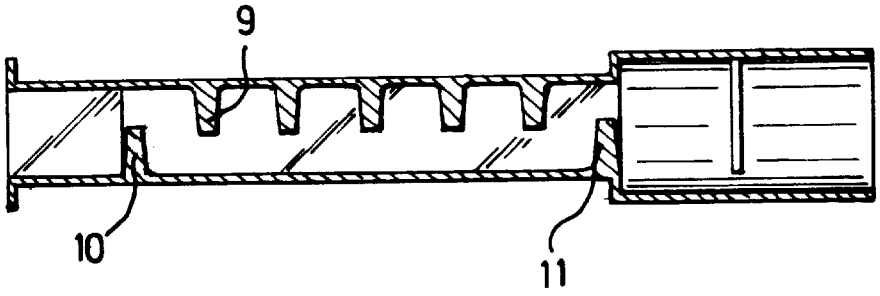
FIG. 7 is a longitudinal section on a plane EE.

FIGS. 6 and 7 show a variant of the above-described antenna. Its structure is identical with the exception of the blades 2, 4, and 6 which are replaced by circular section studs 9, 10, and 11 which perform the same functions as said blades. The iris is inclined relative to the axial direction of the studs.

Figure 8:
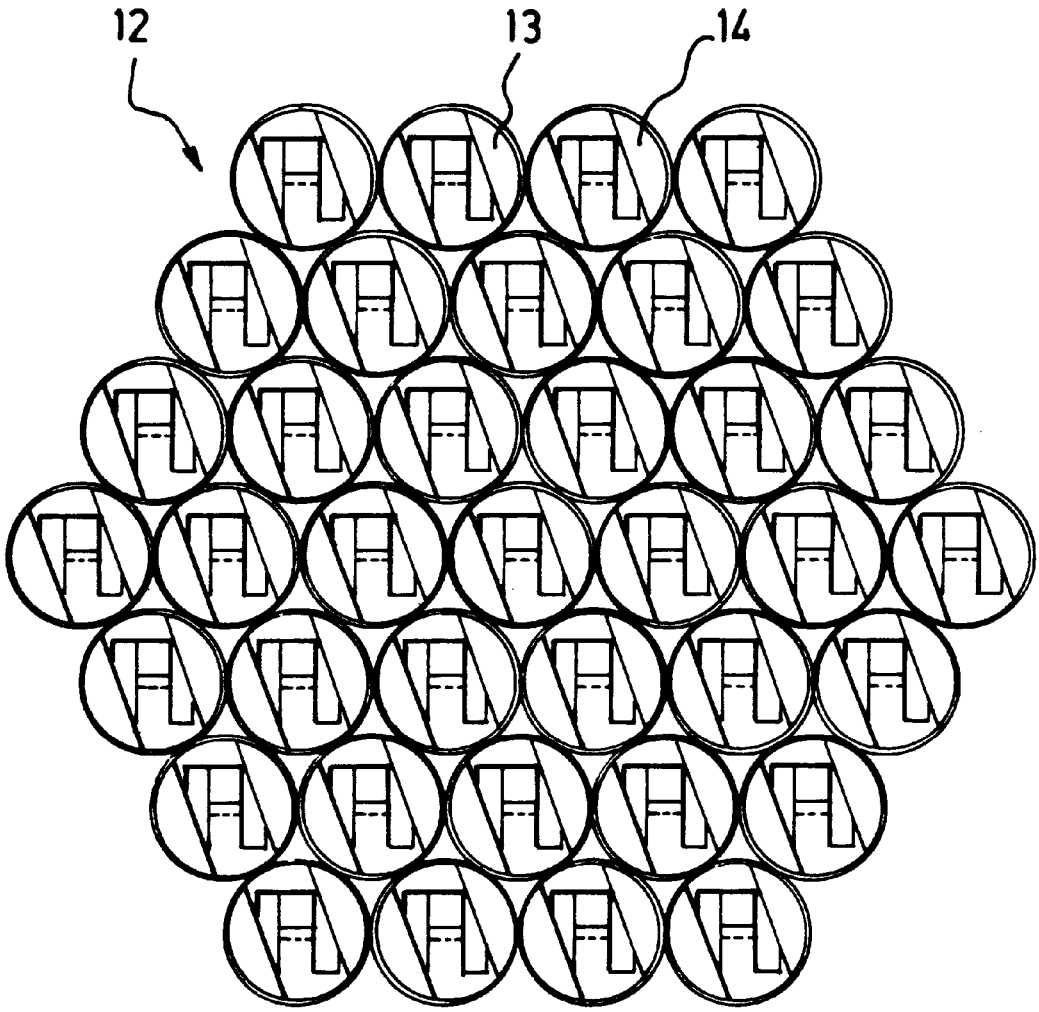
FIG. 8 is a diagrammatic front view of an array antenna seen from its radiating element side.

FIG. 8 shows an array antenna 12 made by fixing together a plurality of elementary antennas as described above in a side-by-side configuration, to form a hexagonal array. The polarizing irises such as 13 and 14 of the various elementary antennas in the example shown have the same orientation in order to synchronize their radiation, thereby simplifying control of the exciter signals in transmission, and analysis of the received signals in reception.

Figure 9:
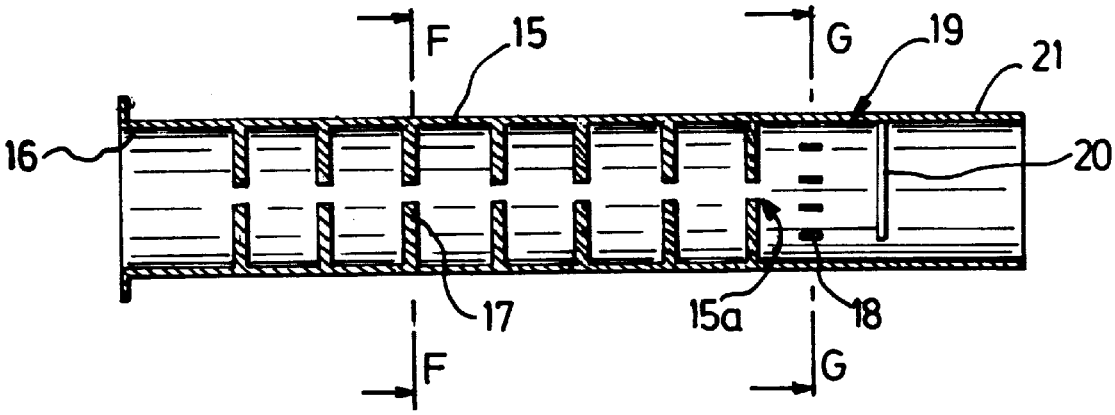
FIG. 9 is a longitudinal section on a plane HH showing another embodiment.
Figure 10:
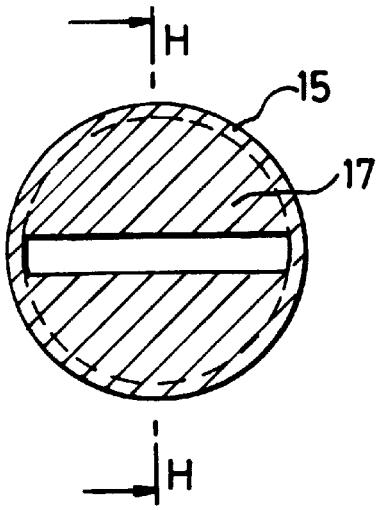
FIGS. 10 and 11 are cross-sections respectively on planes FF and GG.
Figure 11:
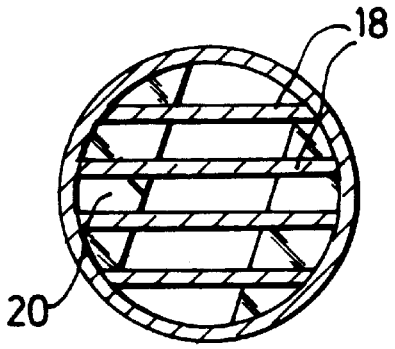

FIGS. 9, 10, and 11 show another embodiment of an antenna of the invention.

The frequency filter is constituted by a cylindrical waveguide 15 having a circular flange 16 at its inlet end. The waveguide 15 is provided internally with a series of discontinuities formed by thick irises such as 17 that are symmetrical about the plane HH containing the electric field of the initial go mode. The waveguide 15 has an inside diameter that is greater than 0.586 $\lambda$ so as to constitute a propagation filter possessing a monomode outlet 15*a* (relative to the excitation of the initial go mode).

At its end, the waveguide 15 has a grid 18 made up of a plurality of transverse strips, each extending perpendicularly to the plane HH containing the electric field of the initial go mode. These strips are disposed so as to have their width in the longitudinal direction of the waveguide. The blades are add-on components in this example.

The waveguide 15 extends beyond the grid 18 in the form of a same-section cylindrical waveguide 19 suitable for conveying both orthogonal fundamental modes of the waveguide. This waveguide 19 provided with the grid 18 acts as a polarization-selective device and performs the same functions as the waveguide 5 provided with the blade 6 as described above.

The polarizing iris 20 and the radiating element 21 are identical to the corresponding parts 7 and 8 of the above-described antenna. The iris 20 is disposed asymmetrically relative to the iris 17 of the filter.

Operation is similar to the preceding antenna. The initial go mode reaches the grid 18 with an electric field that is perpendicular to the strips thereof and is therefore not disturbed by said grid. One of the return modes Rh is not disturbed by the grid 18 and penetrates into the filter 15 which reflects it, while the other return mode Rv is totally reflected by the grid 18 since its electric field is parallel to the strips thereof.

What is claimed is:

1. An antenna with one-way circular polarization, for emitting an initial wave as an emitted wave having circular polarization, the initial wave having a desired mode defining an initial go mode, the antenna comprising:

a radiating element connected to a polarization-selective device;

a means for polarizing said emitted wave, defining a polarizer means, disposed at the transition between the radiating element and the polarization-selective device; and a frequency filter connected to the polarization-selective device;

wherein:

the polarizer means is adapted to ensure that the emitted wave is circularly polarized and to induce two orthogonal return transmission modes;

the polarization-selective device enables the initial go mode to propagate;

the polarization-selective device, in transmission, passes only one of the two orthogonal return transmission modes and reflects the other of the two orthogonal return transmission modes;

the frequency filter, in transmission, reflects the one of the two orthogonal return transmission modes applied thereto by the polarization-selective device; and the polarizer means is positioned so as to be matched to a composite wave made up of the initial go mode of the initial wave and of the reflected one of the two orthogonal return transmission modes so as to reinforce the circular polarization of the initial wave.

2. An antenna according to claim 1, in which the frequency filter is an evanescent mode filter having discontinuities in alignment along the longitudinal axis of the filter and presenting symmetry about a longitudinal plane, wherein the polarization-selective device comprises a circular or rectangular section waveguide having transverse dimensions appropriate for conveying both orthogonal fundamental modes of the waveguide, a discontinuity being disposed at the interface between the filter and the waveguide in alignment with the discontinuities of the filter in order to pass one of the return modes and to reflect the other return mode.

3. An antenna according to claim 1, in which the frequency filter is a propagation filter possessing a monomode outlet constituted by a rectangular or circular waveguide, wherein the polarization-selective device comprises a circular or rectangular section waveguide having transverse dimensions suitable for conveying both orthogonal fundamental modes of the waveguide, a grid of parallel metal wires or strips being disposed at the interface between the filter and the waveguide in order to pass one of the return modes and to reflect the other return mode.

4. An antenna according to claim 1, in which the polarizer means is constituted by at least one iris that is asymmetrical about the plane containing the electric field of the initial go mode.

5. An antenna according to claim 1, in which the polarization-selective device and the radiating element comprise waveguides of transverse dimensions appropriate for allowing propagation solely of the two orthogonal fundamental modes of the waveguides.

6. An antenna according to claim 1, wherein the filter, the polarization-selective device, the polarizer means, and the radiating elements are made as a single piece of electromagnetically linear metal material.

7. An antenna having one-way circular polarization, made up of an array of antennas, each according to claim 1.

* * * * *